US008092551B2

(12) United States Patent
Dye et al.

(10) Patent No.: US 8,092,551 B2
(45) Date of Patent: Jan. 10, 2012

(54) METHOD FOR PRODUCING HOSIERY WITH ALOE FINISH

(76) Inventors: Kenneth Dye, Galion, OH (US); Serge Babayan, Charlotte, NC (US)

( * ) Notice: Subject to any disclaimer, the term of this patent is extended or adjusted under 35 U.S.C. 154(b) by 141 days.

(21) Appl. No.: 12/965,048

(22) Filed: Dec. 10, 2010

(65) Prior Publication Data

US 2011/0138546 A1 Jun. 16, 2011

Related U.S. Application Data

(60) Provisional application No. 61/285,328, filed on Dec. 10, 2009.

(51) Int. Cl.
*D06M 11/58* (2006.01)
*D06M 11/56* (2006.01)
*D06M 11/77* (2006.01)

(52) U.S. Cl. ..... 8/115.6; 8/620; 8/924; 252/8.84; 252/8.63

(58) Field of Classification Search ..... 8/115.6, 8/924, 620; 252/8.84, 8.63
See application file for complete search history.

(56) References Cited

U.S. PATENT DOCUMENTS 5,622,531 A * 4/1997 Yamada et al. ..... 8/115.66
7,282,473 B2 * 10/2007 Hunt et al. ..... 510/349

* cited by examiner

*Primary Examiner* — Amina Khan
(74) *Attorney, Agent, or Firm* — Ashkan A. Aminian; Kremblas & Foster

(57) ABSTRACT

A method for producing pantyhose and other nylon or spandex hosiery with a long-lasting aloe finish is provided. A first step of the method is to place the pantyhose in a dye tub with a quantity of dye mix and ammonia sulfate. The contents of the dye tub are then heated until the pores in the nylon fibers of the pantyhose open and accept the dye molecules. A color fix is then added to the dye tub along with an acid substitute for creating a strong bond between the dye molecules and the nylon fibers. A softening mix containing a cationic nylon softener and a diluted silicone softener is then applied to the pantyhose. Lastly, an aloe finish containing a silicone micro-emulsion is added to the dye tub followed by another quantity of acid substitute for creating a strong bond between the aloe finish and the nylon fibers of the pantyhose.

18 Claims, 1 Drawing Sheet

METHOD FOR PRODUCING HOSIERY WITH ALOE FINISH

CROSS-REFERENCES TO RELATED APPLICATIONS

This application claims the benefit of U.S. Provisional Application No. 61/285,328 filed Dec. 10, 2009.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

The present invention relates generally to the field of hosiery and intimate apparel, and relates more particularly to a method for producing hosiery having an aloe finish, wherein the desired color of the hosiery is preserved and wherein such hosiery are more comfortable to wear than traditional types of hosiery.

In today's fast-paced, progressive environment comfort is often a dominant factor when consumers consider and select products for purchase. Such comfort-minded product selection is particularly evident in the hosiery and intimate apparel industries which provide clothing items that are typically worn in direct contact with the skin of an individual.

Due to the discomfort that is commonly associated with wearing traditional types of pantyhose, the hosiery industry is currently in rapid decline. While technological advancements have facilitated the development of softer yarns, such as microfiber, many women still find pantyhose to be an uncomfortable burden, especially when worn for extended periods of time. Women often endure chaffing, scratching, tightness, dryness, irritability, and a general feeling of discomfort when wearing pantyhose in exchange for maintaining a fashionable and/or professional appearance.

In addition to being uncomfortable, traditional pantyhose can trap bacteria and increase temperature in the genital area, and so can be the proximate cause or a contributing factor in the development of yeast infections (candidiasis) in wearers. The occurrence of bacterial vaginosis has also been linked to the wearing of pantyhose, among other causes. Bacterial vaginosis can result in complications for pregnant women and has been associated with an increase in the development of pelvic inflammatory disease (PID) following surgical procedures such as a hysterectomy. The warm, moist environment created by nylon pantyhose is also a predictive factor in the development of fungal infections of the skin of susceptible wearers, particularly in the feet, abdomen and genital areas. Preexisting fungal and allergic conditions, including eczema, athlete's foot, hives and rashes are exacerbated by the wearing of pantyhose.

In view of the foregoing, it would be advantageous to provide a method for producing pantyhose and other hosiery having a long-lasting aloe finish, wherein such hosiery are comfortable to wear and mitigate the risk of causing a wearer to develop or exacerbate bacterial and/or fungal infections. It would further be advantageous to provide such a method that preserves the desired color shade of the hosiery when the aloe finish is applied.

BRIEF SUMMARY OF THE INVENTION

In accordance with the present invention, there is provided a method for producing pantyhose and other nylon and spandex hosiery having a long-lasting aloe finish while preserving a desired color shade of the hosiery.

A first general step of the inventive method is acid dying. This involves placing the pantyhose in a dye tub with a quantity of dye mix and ammonia sulfate to create an initial bath mix containing evenly distributed dye molecules. The contents of the dye tub are then heated until the pores in the fibers of the pantyhose open and accept the dye molecules. The bath mix is then circulated, heated further, and is then cooled. A color fix is then added to the dye tub along with an acid substitute for creating a strong bond between the dye molecules and the nylon fibers. The acid substitute is preferably a diluted acid base containing Tanacid NA. The bath mix is then heated again.

A second general step of the inventive method is softening. This involves introducing a softening mix containing a cationic nylon softener and a diluted silicone softener into the bath mix. The bath mix is then circulated to distribute the softening mix. The pantyhose are thereby provided with a soft feel, or "handle."

A third and final general step of the inventive method is aloe finishing. This involves introducing a specific quantity of aloe finish, and preferably 10% by volume of bath mix, to the dye tub. The aloe finish preferably contains 35% aloe vera as well as a silicone micro-emulsion that facilitates bonding to the pantyhose fibers. An acid substitute, and preferably a diluted acid base containing Tanacid NA, is again added to the bath mix to promote bonding between the aloe finish and the pantyhose fibers. The bath mix is again heated and circulated.

The above-described method has been shown to produce pantyhose with an aloe finish having an average longevity of 15-20 washes.

Figure 1:
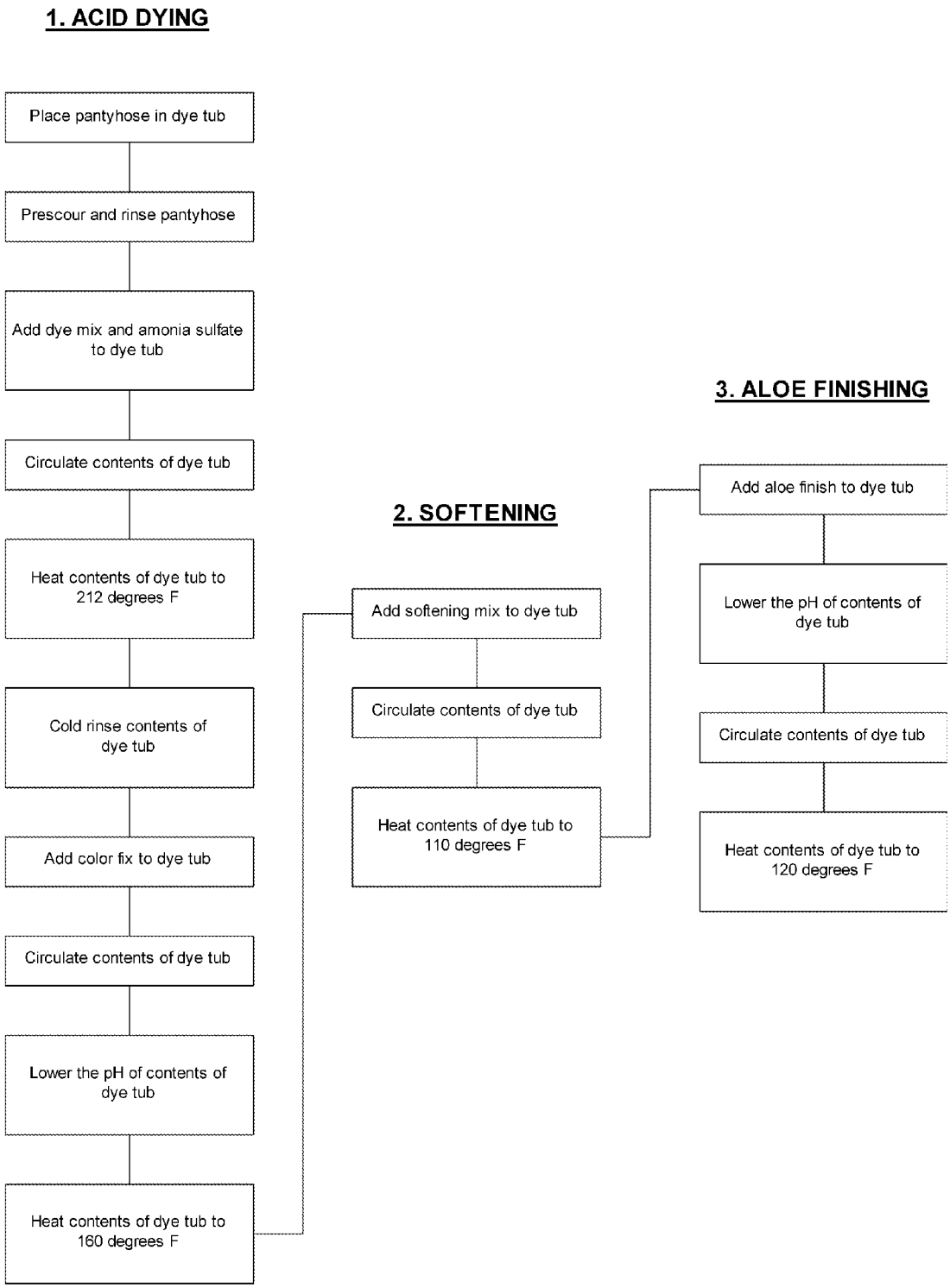
FIG. 1 is a flow chart illustrating the preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

This application claims the benefit of U.S. Provisional Application No. 61/285,328, which is incorporated herein by reference.

Referring to the flow chart shown in FIG. 1, a method for dying and applying an aloe finish to pantyhose is depicted. The term "pantyhose," as used herein, shall refer to any type of hosiery that is partially or entirely made from nylon or spandex, including, but not limited to, trouser socks, knee highs, thigh highs, leggings, tights, body shapers, and traditional pantyhose, including footless varieties of each.

The method embodied by the present invention generally includes three steps: 1) acid dying; 2) softening; and 3) aloe finishing. Each of these steps is described in detail below. Those of ordinary skill in the art will recognize that the described steps involve certain processes that are well known. It is also known to apply aloe to certain types of garments for enhancing comfort and anti-microbial properties. It should be kept in mind, however, that it is the particular combination of the method steps described below, which include several processes that are believed to be novel in the context of the present application, that has been found through extensive experimentation to be successful for the purpose of applying a long-lasting aloe finish to nylon and spandex hosiery items in a manner that preserves the color of the hosiery items.

For the sake of convenience and clarity, only nylon pantyhose are mentioned in the following description of the inventive method. It should be understood, however, that the described method steps can be applied to any type of hosiery that is partially or entirely made from either nylon or spandex.

Acid Dying

Referring to the first step of the inventive method shown in FIG. 1, a quantity of undyed, unfinished pantyhose, commonly referred to as "greige goods," are initially placed in a dye tub. The pantyhose are subjected to a conventional prescouring process at a preferred temperature of at least 100 degrees Fahrenheit, wherein oil is removed from the pantyhose. The pantyhose are then rinsed.

Next, a dye mix and a quantity of amonia sulfate are added to the dye tub (which also contains a quantity of water) to create an initial bath mix. The dye mix is pre-formulated to produce a desired color shade in the pantyhose. The ammonia sulfate is introduced to lower the pH of the bath mix at a very slow rate (slower than conventional acids) thereby slowing the strike rate of the dye mix. A slow strike rate promotes even distribution of the dye mix, which in-turn promotes even coloring and shading in the pantyhose. This is especially important for lighter dye mixes (e.g. those used to produce nude, near-nude, and flesh-tone pantyhose) which are more prone to produce visible spotting than darker dye mixes (e.g. those used to produce black or near-black pantyhose). For this reason, it is contemplated that conventional acids can be substituted for ammonia sulfate if darker dye mixes are used in the dying process.

The initial bath mix is circulated in the dye tub for approximately 10 minutes to allow thorough and even absorption of the dye mix by the pantyhose. The bath mix is then heated to a preferred temperature of about 212 degrees Fahrenheit. Heating the bath mix in this manner causes the pores in the nylon pantyhose to open, thus allowing the dye molecules in the dye mix to enter the pores, or "dye sites," in the nylon. After the heated bath mix is circulated for several minutes the pantyhose are cold rinsed.

Next, a color fix is added to the dye tub. The color fix is a resin composed of clear molecules that are smaller in size than the dye molecules that have been deposited in the pores of the nylon. The color fix is introduced into the dye tub at a relatively cool water temperature and is circulated in the dye tub for at least five minutes to assure even distribution of the fix. An acid substitute, and preferably a diluted acid base containing Tanacid NA, is then added to the dye tub to lower the pH of the mix. The strike rate of the bath mix is thereby slowed, thus facilitating an even distribution of the color fix. The introduction of the acid base into the bath mix also imparts a charge to the nylon pantyhose, thereby increasing the affinity of the oppositely-charged dye and resin molecules for the nylon fibers (discussed in greater detail below).

Next, the bath mix is heated to a preferred temperature of about 160 degrees Fahrenheit, causing the pores in the nylon pantyhose to open. As the temperature in the bath mix rises, the pH level of the bath mix gradually decreases to a range of about 4.5-5.0, a level at which the acidic bath mix drives the color fix molecules into the pores of the nylon fibers. The color fix molecules fill into the empty spaces in the nylon pores that surround the larger dye molecules, thereby firmly setting the dye molecules within the pores. This can be likened to pouring sand into buckets full of large rocks, wherein the buckets are analogous to the nylon pores, the rocks are analogous to the dye molecules, and the grains of sand are analogous to the color fix molecules. The affinity of the charged dye and color fix molecules for the oppositely-charged nylon fibers causes the dye and color fix molecules to set even more firmly into the pores of the nylon, thus locking the color of the dye into the pantyhose. This color fixation process is critical for protecting the color shade of the pantyhose against color loss or alteration that could otherwise occur during subsequent application of the aloe finish (described below).

Softening/Finishing

Referring to the next step of the inventive method shown in FIG. 1, a softening mix is added to the dye tub. The softening mix preferably contains a standard 4% cationic nylon softener and a 1% diluted silicone softener. The softening mix is applied at a preferred temperature of about 110 degrees Fahrenheit, which is sufficient for causing the softening mix to adhere to the nylon pantyhose. The contents of the dye tub are then circulated to distribute the softening mix.

The application of the softening mix provides the pantyhose with a soft feel, or "handle." The use of a diluted silicone softener is preferred for its longevity and exceptionally soft handle when applied to nylon. However, those of ordinary skill in the art will recognize that certain problems, including spotting and seam slippage, are associated with the use of silicone softening agents. Furthermore, silicone is much more expensive than other, traditional softeners. It is therefore contemplated that other suitable softening agents can be substituted for the described silicone softening agent without departing from the present invention.

Aloe Finishing

Referring to the next step of the inventive process shown in FIG. 1, an aloe finish is added to the bath mix. The aloe finish includes a concentrated softener containing about 35% aloe vera that is incorporated into a silicone matrix to create a silicone micro-emulsion. The aloe molecules and silicone molecules form covalent bonds, which is critical because the silicone molecules ultimately facilitate adhesion of the aloe finish to the nylon fibers of the pantyhose. That is, aloe molecules will not adhere to nylon fibers on their own. It is contemplated that a suitable softening agent other than silicone can additionally or alternatively be incorporated into the aloe finish for facilitating adhesion to the nylon fibers of the pantyhose. It has been found through extensive experimentation that the optimal amount of aloe finish per quantity of dye bath mix (consisting mostly of water) is about 10%.

Next, an acid substitute, and preferably a diluted acid base containing Tanacid NA, is added to the bath mix. It has been found through extensive experimentation that the optimal amount of acid substitute per quantity of dye bath mix is about 1%. The bath mix is then heated to a temperature of about 120 degrees Fahrenheit as is circulated. As with the dye and color fix molecules described above, the application of heat and the introduction of the acid substitute reduce the pH of the aloe finish to a preferred range of 4.5-5.0, thereby increasing the affinity of the aloe finish for the nylon fibers of the pantyhose to create a strong molecular bond therebetween. The aloe finish bonds to the exterior of the nylon fibers and enters the pores of the fibers. It has been found through experimentation that a bath mix temperature of 120 degrees Fahrenheit is optimal for facilitating swelling and relaxation of the nylon fibers of the pantyhose and the bonding of the aloe finish to the nylon fibers, although variations in temperature are contemplated.

An alternative embodiment of the inventive method is contemplated in which the aloe finishing process is performed prior to the above-described softening process, although this is generally not preferred as it has been shown that the softening process can result in the loss or reduction of a previously applied aloe finish. Moreover, it has been found that applying the aloe finish after the softening process results in a finished product having a softer handle.

After all of the steps of the above-described method have been completed, the finished pantyhose can be removed from the dye tub and passed along for further processing, such as tumble drying, boarding, and packaging. It has been found that the applied aloe finish can be maintained for a minimum of 10, and up to as many as 20 washes, which typically exceeds the useful life of a pair of pantyhose.

The inventive method thus provides a means for efficiently and effectively imparting a long-lasting aloe finish to various types of nylon spandex hosiery items while preserving the desired color shade of such items. The items produced by the inventive method exhibit superior feel, longevity, and antimicrobial properties relative to hosiery items that are produced using more traditional methods.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A method for producing pantyhose having a long lasting aloe finish, the method comprising:

a) placing the pantyhose in a dye tub;
b) adding dye mix and ammonia sulfate to the contents of the dye tub;
c) heating the contents of the dye tub until pores in the pantyhose expand to allow the entry of dye molecules;
d) adding a color fix to the contents of the dye tub;
e) lowering the pH of the contents of the dye tub;
f) adding a softening mix to the dye tub;
g) adding an aloe finish containing silicone to the dye tub;
h) repeating the step of lowering the pH of the contents of the dye tub; and
i) heating the contents of the dye tub to a temperature of about 120 degrees Fahrenheit after the second instance of lowering the pH of the contents of the dye tub.

2. The method in accordance with claim 1, further comprising the step of prescouring and rinsing the panty hose to remove oil.

3. The method in accordance with claim 1, wherein the first instance of lowering the pH of the contents of the dye tub comprises adding an acid substitute to the contents of the dye tub.

4. The method in accordance with claim 1, wherein the second instance of lowering the pH of the contents of the dye tub comprises adding an acid substitute to the contents of the dye tub.

5. The method in accordance with claim 1, wherein the first instance of lowering the pH of the contents of the dye tub comprises lowering the pH of the contents of the dye tub to a pH in a range between 4.5 and 5.

6. The method in accordance with claim 1, wherein the second instance of lowering the pH of the contents of the dye tub comprises lowering the pH of the contents of the dye tub to a pH in a range between 4.5 and 5.

7. The method in accordance with claim 1, wherein the step of adding a softening mix to the dye tub comprises adding a standard 4% cationic nylon softener and a 1% diluted silicone softener to the dye tub.

8. The method in accordance with claim 1, wherein the step of adding a softening mix to the dye tub comprises adding a softening mix to the dye tub at a temperature of about 110 degrees Fahrenheit.

9. The method in accordance with claim 1, wherein the step of heating the contents of the dye tub in step c) comprises heating the contents of the dye tub to a temperature of about 212 degrees Fahrenheit.

10. The method in accordance with claim 1, further comprising the step of heating the contents of the dye tub to a temperature of 160 degrees Fahrenheit after the step of adding a color fix to the contents of the dye tub.

11. The method in accordance with claim 1, wherein the step of adding an aloe finish containing silicone to the dye tub comprises adding a quantity of 10% aloe finish relative to a quantity of bath mix in the dye tub.

12. A method for producing pantyhose having a long lasting aloe finish, the method comprising:

a) placing the pantyhose in a dye tub;
b) prescouring and rinsing the pantyhose to remove oil;
c) adding dye mix and ammonia sulfate to the contents of the dye tub;
d) heating the contents of the dye tub to a temperature of about 212 degrees Fahrenheit;
e) cold rinsing the contents of the dye tub;
f) adding a color fix to the contents of the dye tub;
g) lowering the pH of the contents of the dye tub;
h) heating the contents of the dye tub to a temperature of about 160 degrees Fahrenheit;
i) adding a softening mix to the dye tub at a temperature of about 110 degrees Fahrenheit;
j) adding an aloe finish containing silicone to the dye tub;
k) lowering the pH of the contents of the dye tub; and
l) heating the dye tub to a temperature of about 120 degrees Fahrenheit.

13. The method in accordance with claim 12, wherein the first instance of lowering the pH of the contents of the dye tub comprises adding an acid substitute to the contents of the dye tub.

14. The method in accordance with claim 12, wherein the second instance of lowering the pH of the contents of the dye tub comprises adding an acid substitute to the contents of the dye tub.

15. The method in accordance with claim 12, wherein the first instance of lowering the pH of the contents of the dye tub comprises lowering the pH of the contents of the dye tub to a pH in a range between 4.5 and 5.

16. The method in accordance with claim 12, wherein the second instance of lowering the pH of the contents of the dye tub comprises lowering the pH of the contents of the dye tub to a pH in a range between 4.5 and 5.

17. The method in accordance with claim 12, wherein the step of adding an aloe finish containing silicone to the dye tub comprises adding a quantity of 10% aloe finish relative to a quantity of bath mix in the dye tub.

18. The method in accordance with claim 12, wherein the step of adding a softening mix to the dye tub comprises adding a standard 4% cationic nylon softener and a 1% diluted silicone softener to the dye tub.

* * * * *